United States Patent [19]

Gottschalk

[11] Patent Number: 4,697,354

[45] Date of Patent: Oct. 6, 1987

[54] DRIER FOR MOVING SHEET MATERIAL

[75] Inventor: Karl-Heinz Gottschalk, Hamburg, Fed. Rep. of Germany

[73] Assignee: Babcock Textilmaschinen GmbH, Seevetal-Maschen, Fed. Rep. of Germany

[21] Appl. No.: 770,069

[22] Filed: Aug. 28, 1985

[51] Int. Cl.[4] ..... F26B 3/04; F26B 13/02

[52] U.S. Cl. ..... 34/23; 34/34; 34/54; 34/216; 34/217

[58] Field of Search ..... 34/216, 217, 50, 54, 34/86, 34, 23

[56] References Cited

U.S. PATENT DOCUMENTS

| | | | |
|---|---|---|---|
| 2,197,776 | 4/1940 | Argabrite et al. | 34/216 |
| 3,849,904 | 11/1974 | Villalobos | 34/216 |
| 4,270,283 | 6/1981 | Ellis | 34/216 |
| 4,326,342 | 4/1982 | Schregenberger | 34/216 |
| 4,439,930 | 4/1984 | McMahon, Jr. | 34/216 |

FOREIGN PATENT DOCUMENTS

| | | | |
|---|---|---|---|
| 0053269 | 10/1981 | European Pat. Off. . | |
| 2058291 | 6/1971 | Fed. Rep. of Germany . | |
| 2443395 | 4/1976 | Fed. Rep. of Germany . | |
| 2523411 | 12/1976 | Fed. Rep. of Germany | 34/50 |
| 3012880 | 10/1981 | Fed. Rep. of Germany . | |

*Primary Examiner*—Larry I. Schwartz

*Attorney, Agent, or Firm*—Collard, Roe & Galgano

[57] ABSTRACT

A drier for moving and drying textile materials, wherein the material web passes through several sequentially arrayed identical drying zones during the drying treatment which is implemented by fresh air, circulating air and exhaust air. The improvement includes a central exhaust duct which evacuates exhaust air from all drying zones. Preferably, the drier additionally controls the evacuation of the exhaust air from the drier as a function of the moisture in the exhaust air flow. The exhaust duct may also evacuate exhaust air from the first, central or last drying zone through which the web material passes.

8 Claims, 8 Drawing Figures

FIG.1
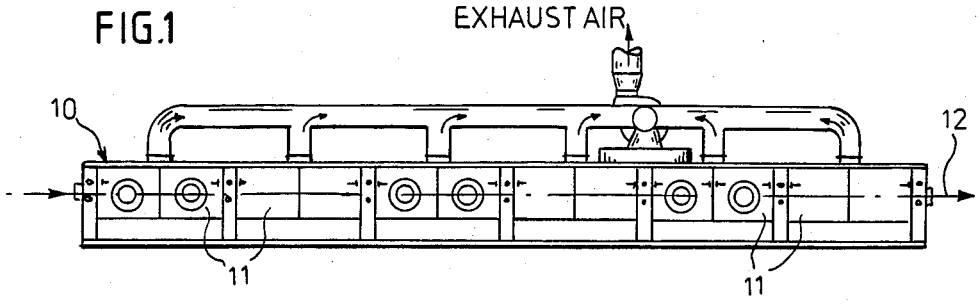
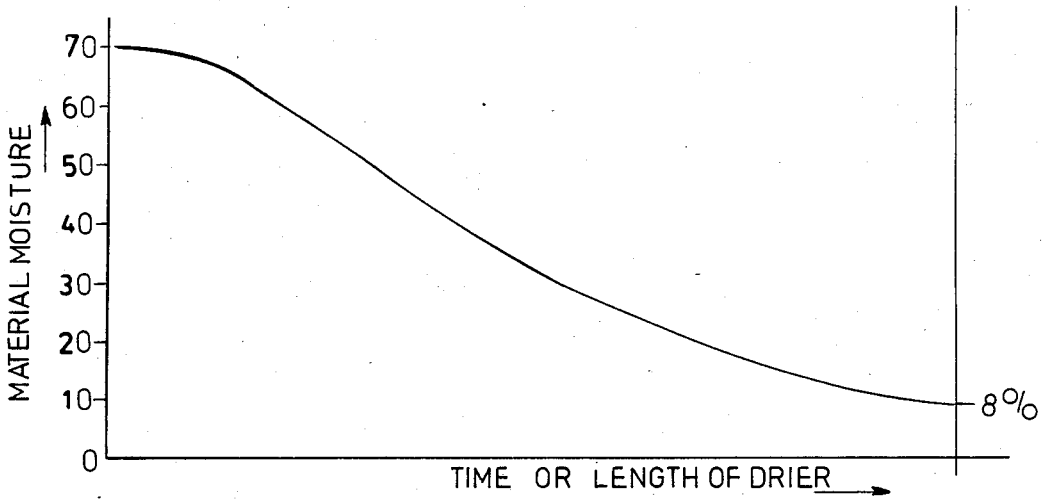
FIG.5
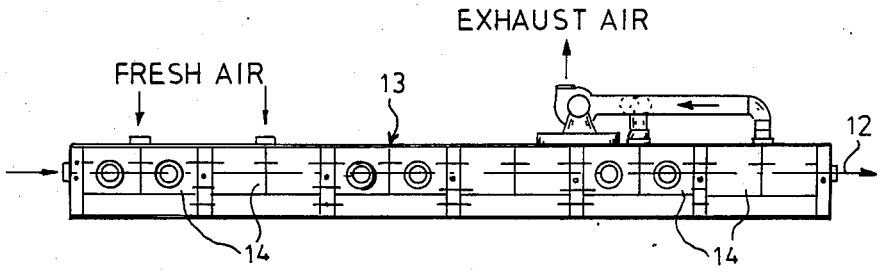
FIG.3

FIG.2a
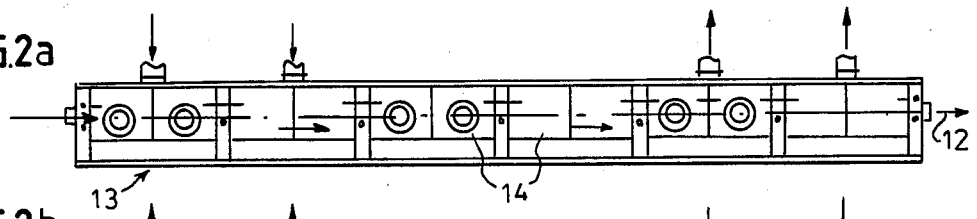
FIG.2b
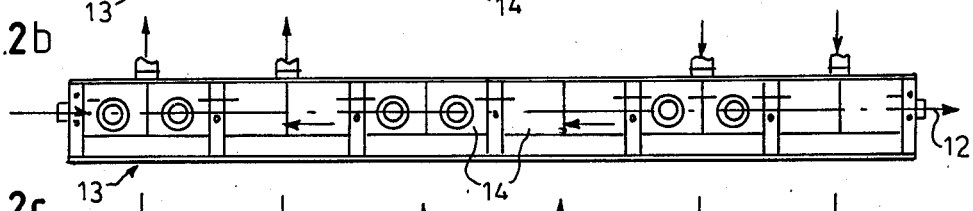
FIG.2c
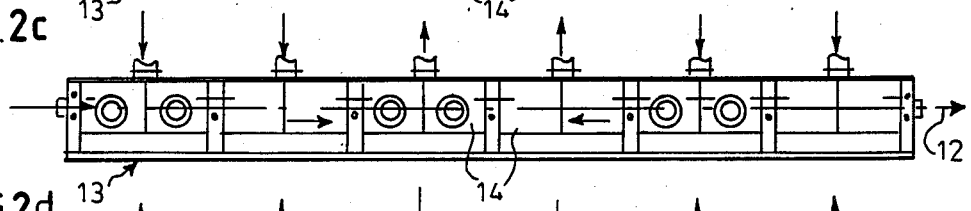
FIG.2d
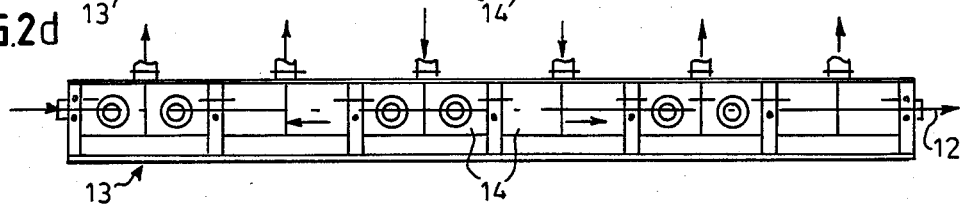
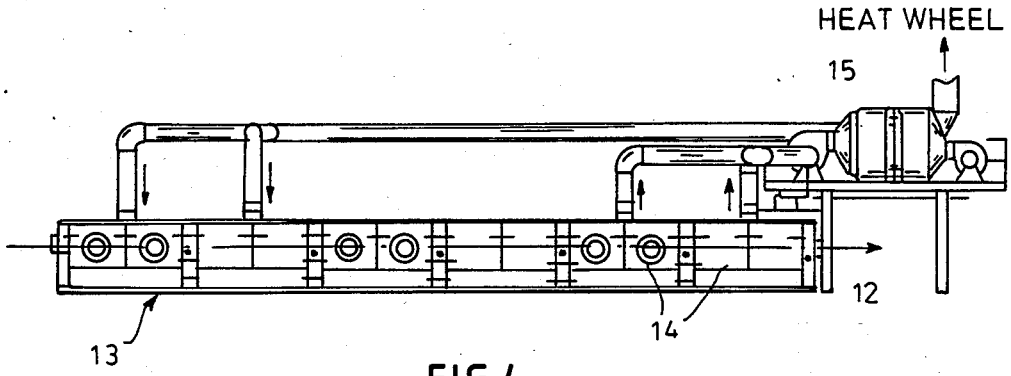
FIG.4

DRIER FOR MOVING SHEET MATERIAL

BACKGROUND

This invention relates to a drier for drying lengths or webs of sheet material such as textiles and the like.

More particularly, this invention relates to a drier for moving and drying textiles etc., wherein the lengths of material sequentially pass through several identical drying zones, or several identical pairs of drying zones in counter type driers, during the drying treatment implemented by fresh air, circulating air and exhaust air.

It is known that in accordance with the drying curve, most of the water is evaporated from a textile material at the beginning of drying with decreasing evaporation in the following drying sections. Therefore, in conventional driers, very moist exhaust air is evacuated in the first drying zones, and air with low humidity is evacuated from the latter zones. This process is uneconomical due to the waste of energy.

Due to high energy costs, it is necessary that all processes involved in textile finishing be optimized to minimize energy consumption. It is therefore uneconomical to follow the present method of first handling the treating process with high energy consumption in order to recover part of the energy by means of energy recovery systems.

Accordingly, it is an object of the present invention to provide a drier using treatment procedures which are optimized with respect to energy consumption, and which require a minimum amount of energy for the treating procedure.

SUMMARY OF THE INVENTION

Accordingly, the present invention provides a drier having several identical drying zones wherein exhaust air is evacuated from all drying zones of the drier via a central evacuator. In an alternative embodiment, the exhaust air is evacuated centrally from only one drying zone or one pair of drying zones.

The exhaust air can be evacuated from the drier at a rate depending on the proportion of moisture in the exhaust air, for example, by controlling the angular speed of the central exhaust blower as a function of the exhaust-air humidity. In this manner, it is possible to exhaust only air with a high moisture content into the atmosphere, and thus save substantial amounts of exhaust air in comparison to the present driers, so as to save energy.

The exhaust air is evacuated according to the invention in the direction of movement of the web of material only in the last, or only in the first drying zone or pair of drying zones, or alternatively only in one of the central drying zones or pairs of drying zones. Appropriately the drier housing is designed extensively with hermetic seals to prevent external air admission. Entry and exit seals are therefore provided at the entrance and exit of the drier housing. Moreover, fresh air openings are mounted in specific drying zones at the dryer entry, ahead of the heaters, to provide for a defined supply of fresh air. Also, increased heat outputs are provided is these areas.

Furthermore, according to the steps of the invention, a heat exchanger may be used in known manner to transfer heat from the exhaust air to the fresh air in order to preheat it and thus save energy.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings wherein similar reference characters denote similar elements throughout the several views:

FIG. 1 is a schematic side elevational view of a conventional tenter frame drier, and its drying curve;

FIG. 2 is a series of four schematic side elevational views of various ways of applying the treating agent in the drier according to the invention;

FIG. 3 is a schematic side elevational view of another embodiment of the invention with a central air supply located at the beginning of the drier, and with a central exhaust duct located at the end of the drier;

FIG. 4 is a schematical side elevational view of a third embodiment of the invention having heat recovery from the exhaust air; and FIG. 5 is a curve of moisture vs. the length of dryer for the embodiment of FIG. 1.

Referring to FIG. 1, the web material enters a drier 10 with an initial moisture content typically of 70% and leaves this drier with a residual moisture of about 8%. When plotting the drying curve along the length of the drier, the graph of FIG. 5 is obtained.

In drier 10 of FIG. 1, with air being exhausted from each drier zone 11, the length of web material 12 enters the drier with an initial moisture of 70% and in the course of drying leaves the dryer with a residual moisture of about 8%. If the drying curve, which shows the moisture in the material, is plotted as a function of the drier length, then it becomes clear that most of the water evaporates in the first zones of the dryer, and very little water evaporates in the latter zones. The rate of drying is defined by the slope of the drying curve. Thus, the steeper the tangent to the curve, the higher the rate of drying.

The high rate of evaporation at the beginning of the drying process is due to ample surface water being available for evaporation following the heating of the material. The slow evaporation in the second drying section is explained by the water first being required to diffuse toward the surface before evaporating. If much water is evaporated in the first zones, then for uniform evacuation of exhaust air in all zones there will be high moisture content in the exhausted air. Corresponding moisture contents are present at low evaporation in the last zones. Accordingly this still widely conventional system using fresh-air supply and exhaust of air by the drier does not provide for economical operation because the exhausted air displays different moisture contents across the length of the drier (more moisture in the front zones, less in the rear ones). It is virtually impossible to optimally set the many individual control members by hand for the fresh air, and therefore they are not used in practice.

FIG. 2 shows schematically various ways in which the invention implements supplying air to drier 13 and exhausting air from it. The direction of movement of web material 12 through the drier is also shown in each Figure. Accordingly, FIG. 2*a* shows the air being; moved in the forward direction, i.e. fresh air is fed in at the beginning of the drier and web material 12 passes through the drier in the same direction as does the air. Exhaust air is evacuated at the end of the drier. FIG. 2*b* shows the air being moved in counterflow, with fresh air being fed in at the end of drier 13, flowing through the drier opposite to the direction of movement of the material and then being evacuated at the beginning of the drier. FIGS. *2c* and *2d* show combined systems. In particular, FIG. *2c* shows the front part of drier 13 having a forward air flow and the rear part having a counterflow. In all cases however, there is only one central evacuation of the exhaust air. Similarly, the air being moved in FIG. *2d* is in counterflow at the front part of drier 13 and in forward flow at its rear part. In this embodiment also, the air flows in a particular motion and only one central exhaust air duct is provided.

In drier 13 of the counter-type design shown in FIG. 3, fresh air is fed in at the first pair of drying zones 14 and evacuated in the last pair of zones 14. The air therefore passes through the drier in the forward direction, that is, in the direction of movement of the material.

The principle of central air supply at the beginning of the drier, with an automatic central rate-controlled evacuation of the exhaust air at the end of the drier and hence with forward motion of the air offers the following advantages:

During the drying process, the front zones can be operated with higher circulating air temperatures. Therefore the evaporation performance can be increased in these zones. The last or back zones operate with lower circulating air-temperatures. As a result the heat loss by the lower-temperature exhaust air, which is merely evacuated here, will be reduced.

Higher material temperatures are obtained in the drying process in the last zones. This increases the rate of diffusion of the water to the web surface, and leads to an additional increase in drying performance, as demonstrated by theoretical work and practical experiments.

Any vapors from avivage (i.e., the fabric finish) occurring during the fixation process are evacuated from the drier in the direction of increasing material temperature and thereby condensation on the material is prevented. Avivage vapors cannot arrive at colder drying zones during the combined drying and fixation, where they might condense. Moreover, during the combined drying and fixing, the moisture content in the circulating air is higher at the rear zones, thereby reducing the danger of fading.

These advantages may be partly combined to permit the central evacuation of the exhaust air with forward air motion in the front part of the dryer, and counterflow in the rear part of the dryer (counterflow meaning airflow opposite to the direction of movement of the material). The central evacuation of the exhaust air optimizes energy use, but it does provide energy recovery.

Nevertheless it is possible using this airflow system and additional equipment to recover thermal energy also for the case of the tenter frame, for example, using a heat wheel 15 or heat exchanger as shown in FIG. 4. Quantities of exhaust air economical for heat recovery occur when drying is done on very long tenter frames with many drying zones and when thermosetting unwashed materials with dense avivage vapors. In every case however, a smaller heat recovery unit can be used than would be the case for a drier without a central exhaust-air duct.

What is claimed is:

1. A drier for conveying and drying webs of material wherein the web passes through sequentially arrayed substantially identical front, central and back drying zones disposed within a hermetic drier housing, during the drying treatment, the drier including means for supplying air to the zones and means for moving, heating and circulating air, within the zones, and seals disposed at the entry and exit of the drier housing, said drying treatment implemented by fresh air, circulating air and exhaust air, wherein the improvement conprises:

an exhaust duct for evacuating exhaust air by suction from all zones of the drier only in the direction of travel of the web, said duct centrally connected to only said back zone; and means for controlling the evacuation of exhaust air as a function of the moisture in it.

2. The drier according to claim 1, wherein specific drying zones include fresh air openings mounted at the entry of said drying zones ahead of heaters, said openings providing a controlled supply of fresh air.

3. The drier according to claim 1, wherein said housing additionally includes an inlet and an outlet for the web, and inlet and outlet seals disposed at said inlet and outlet, respectively, for sealing said housing against the web.

4. The drier according to claim 1, additionally including means for providing additional heat to the zone to which said duct is connected.

5. The drier according to claim 1, additionally including a heat exchanger connected to said exhaust duct and to the means for supplying air, for transferring heat from the exhaust air to the fresh air in order to preheat the fresh air.

6. A process for drying webs of material moving through a drier having continuous sequentially arranged substantially identical front, central and back drying zones, which comprises the steps of:

supplying fresh air into only the front zone;

circulating air within each zone;

evacuating exhaust air from all zones only in the direction of travel of the material via an exhaust duct connected only to the back zone; and automatically controlling the rate of evacuation of exhaust air as a function of the moisture in it.

7. The process according to claim 6, additionally including the steps of:

directing the air to flow in the direction of travel of the moving web;

operating the front zone with high circulating air temperatures; and operating the back zone with lower circulating air temperatures.

8. The process according to claim 7 additionally including the steps of recovering thermal energy from the evacuated air by passing it through a heat exchanger.

* * * * *